US010695765B2

(12) United States Patent
Jensen

(10) Patent No.: US 10,695,765 B2
(45) Date of Patent: Jun. 30, 2020

(54) APPARATUS FOR GRINDING PARTICULATE MATERIAL

(71) Applicant: FLSmidth A/S, Valby (DK)

(72) Inventor: Lucas Jensen, Brønshøj (DK)

(73) Assignee: FLSmidth A/S (DK)

( * ) Notice: Subject to any disclaimer, the term of this patent is extended or adjusted under 35 U.S.C. 154(b) by 434 days.

(21) Appl. No.: 15/529,219

(22) PCT Filed: Dec. 1, 2015

(86) PCT No.: PCT/DK2015/050369
§ 371 (c)(1),
(2) Date: May 24, 2017

(87) PCT Pub. No.: WO2016/091264
PCT Pub. Date: Jun. 16, 2016

(65) Prior Publication Data

US 2017/0333910 A1 Nov. 23, 2017

(30) Foreign Application Priority Data

Dec. 10, 2014 (DK) ..... 2014 70773

(51) Int. Cl.
*B02C 4/00* (2006.01)
*B02C 4/28* (2006.01)
(Continued)

(52) U.S. Cl.
CPC ..... *B02C 4/286* (2013.01); *B02C 4/02* (2013.01); *B02C 4/30* (2013.01)

(58) Field of Classification Search
CPC ..... B02C 4/30; B02C 4/02; B02C 4/286
(Continued)

(56) References Cited

U.S. PATENT DOCUMENTS 769,635 A * 9/1904 Rankin ..... B02C 18/225 241/223
2,150,984 A * 3/1939 Near ..... B23D 31/008 100/151
(Continued)

FOREIGN PATENT DOCUMENTS

DE 3732723 A1 9/1988
EP 0386520 A2 9/1990
(Continued)

OTHER PUBLICATIONS

International Search Report and Written Opinion dated Mar. 1, 2016, 6 pages.

*Primary Examiner* — Faye Francis
(74) *Attorney, Agent, or Firm* — Jeffrey A. Sharp

(57) ABSTRACT

An apparatus for grinding particulate material having a roller press having a pair of grinding rollers each having a rotation axis and being arranged oppositely and parallel to define a grinding roller gap in a common plane through the axes of the rollers, and a mechanical conveying device for conveying granular material to the roller press having a proximal end and a distal end relative to the roller press, the roller press being arranged at the proximal end of the conveying device. The conveying device is arranged to constrain a flow or mat of the granular material having in a cross sectional view a rectangular shape with a mid-plane and to transfer the flow or mat of granular material directly to the grinding roller gap of the roller press in a linear transfer plane being coincident with the mid-plane and perpendicular to the common plane through the axes of the rollers.

13 Claims, 6 Drawing Sheets

(51) Int. Cl.
*B02C 4/02* (2006.01)
*B02C 4/30* (2006.01)

(58) Field of Classification Search
USPC ..... 241/223
See application file for complete search history.

(56) References Cited

U.S. PATENT DOCUMENTS 2,226,330 A * 12/1940 Symons ..... B02C 13/26 241/186.35
2,235,918 A * 3/1941 Dion ..... A01F 29/10 241/152.1
2,453,008 A * 11/1948 Fowler ..... B02C 13/286 241/101.4
3,491,956 A * 1/1970 Barbod ..... B02C 18/28 19/83
3,670,972 A * 6/1972 Quinn ..... B02C 21/02 241/101.76
3,897,018 A * 7/1975 Wilkes ..... B65B 69/00 19/80 R
3,998,396 A * 12/1976 Umphrey ..... B02C 4/08 241/81
4,018,392 A * 4/1977 Wagner ..... B02C 18/0007 241/167
4,127,061 A * 11/1978 Husky ..... A01D 85/004 100/100
4,183,472 A * 1/1980 Packard ..... A01F 29/005 198/533
4,377,259 A * 3/1983 Areaux ..... B02C 4/08 241/236
4,401,205 A * 8/1983 Komossa ..... A24B 7/14 100/151
4,522,096 A * 6/1985 Niven, Jr. ..... A24B 7/06 241/223
4,913,360 A * 4/1990 Lane ..... B02C 18/0007 241/223
5,261,171 A * 11/1993 Bishop ..... B07B 1/005 209/257
5,284,303 A * 2/1994 Galletti ..... B03B 9/061 209/17
5,533,684 A * 7/1996 Bielagus ..... D21B 1/02 144/162.1
5,741,087 A * 4/1998 Osadchuk ..... B07B 1/10 209/257
5,881,959 A * 3/1999 Hadjinian ..... B02C 18/145 241/186.35
6,588,688 B1 * 7/2003 Rossler ..... B02C 18/2241 241/223
6,666,393 B2 * 12/2003 Weir ..... D06F 95/00 241/223
7,357,340 B2 * 4/2008 Castronovo ..... B02C 18/0007 241/223

FOREIGN PATENT DOCUMENTS

WO 2009068921 A1 6/2009
WO 2011/089241 A 7/2011

* cited by examiner

APPARATUS FOR GRINDING PARTICULATE MATERIAL

FIELD OF THE INVENTION

The present invention relates to an apparatus for grinding particulate material comprising

- a roller press for grinding the particulate material and comprising a pair of grinding rollers each having a rotation axis and being arranged oppositely and parallel to define a grinding roller gap in a common plane through the axes of the rollers,
- a conveying device, preferably a mechanical conveying device, for conveying granular material to the roller press and having a proximal end and a distal end relative to the roller press, the roller press being arranged at the proximal end of the conveying device.

BACKGROUND OF THE INVENTION

Roller press apparatuses are used for grinding different kinds of particulate materials such as e.g. limestone, cement clinker, slag sand, old concrete and additionally materials of the mineral/mining industry.

Traditional roller press apparatuses often have an unfavorable throughput-to-speed behavior in the sense that an increase of the peripheral velocity of the rollers is only possible up to a certain point. Thereafter, a further increase of the velocity does not result in a corresponding increase of the throughput. One explanation could be the difficulty in obtaining an acceleration of the material which is to be ground to achieve a speed essentially corresponding to the peripheral velocity. Further, vibration problems frequently arise due to uneven supply of material with different sizes of the particles of the material supplied to the gap of the roller press and/or air being entrained in the particulate material delivered to the gap of the roller press.

EP 1 261 431 B1 discloses an apparatus for grinding particulate material comprising a roller press or mill and an essentially vertically arranged shaft for feeding particulate material to the roller gap and having a downwardly increasing reduction in cross sectional circumference per height unit.

U.S. Pat. No. 6,517,016 B1 discloses a so-called belt roller mill comprising a plate conveyer belt guided continuously round a drive roller and a reversing roller and a grinding roller arranged vertically above the drive roller. A feeding device in the form of a feeding container feeds by means of the gravity particulate material to the upper run of the plate conveyer belt forming a layer i.e. a mat of material thereon. The belt transfers the material to a grinding gap between the upper grinding roller and the portion of the plate conveyer belt above the drive roller. It is to be assumed that the use of a plate conveyer entails many problems due to heavy load of the plate conveyer belt in the grinding zone where the planar plates cooperate with the cylindrical upper grinding roller and problems in guiding the planar plates over the lower drive roller.

U.S. Pat. No. 8,292,207 B2 discloses an apparatus for grinding of particulate material comprising a material feeding container delivering a layer i.e. mat of material essentially at the apex of the outer surface of a lower driven grinding roller. The lower grinding roller transfer the mat of material into a grinding gap formed between the lower roller and an upper grinding roller arranged in an offset manner above the lower grinding roller. The supply of the granular material to the outer surface of the lower roller and the delivery of the material to the grinding gap by means of the outer surface of lower roller is believed to create some problems and restrict the allowable peripheral velocity speed of the rollers and the throughput of the apparatus.

SUMMARY OF THE INVENTION

The object of the present invention is to alleviate at least some of the drawbacks of known apparatuses comprising a roller press for grinding particulate material and a conveying device, preferably a mechanical conveying device, for conveying granular material to the roller press and to provide a cost effective and reliable apparatus allowing for an increased throughput and capacity.

The apparatus according to the invention is characterized in that the conveying device is arranged and configured to be supplied with and/or form and preferably constrain a flow or mat of the granular material having, in a cross sectional view, an essentially rectangular shape with a mid-plane and to transfer the flow or mat of granular material directly to the grinding roller gap of the roller press in an essentially linear transfer plane being essentially coincident with the mid-plane and preferably essentially perpendicular to the common plane through the axes of the rollers.

By the term "mechanical conveying device" is to be understood a conveying device wherein material is accelerated and conveyed by mechanical means in contrast to devices where the material is accelerated and conveyed my natural means such as e.g. the gravity.

By the term "constrained flow or mat of material" is to be understood that the mat or flow of material has a predetermined defined cross section without being necessarily physically constrained by physical means. The mat or flow can be constrained due to the way it is projected from the conveying device or by means of physical means or by a combination of the two.

The conveying device is arranged and configured to transfer the flow or mat of particulate material directly to the gap in a linear plane coincident with the mid-plane of the mat. This means that the mat is transferred from the conveyer device to the gap of the roller press along an at least essentially linear transfer path and without being subjected or essentially being subjected to any directional change. As a result, the mat of material can be delivered to the gap with a high velocity and thereby pressed or forced into the gap to an extend dependent of the velocity of the material.

Tests have shown that it is thereby possible to obtain increased throughput and capacity. Without being bound to the explanation, it is believed that the angle (the so-called gripping angle) over which the respective rollers grip the material delivered to the gap increases with increased velocity of the material delivered to the grinding gap and thereby assists in obtaining an improved throughput and capacity of the apparatus.

The apparatus can comprise a feeding device being arranged and configured for feeding granular material to the conveying device, preferably at the distal end of the conveying device.

In an embodiment of the apparatus according to the invention, the conveying device comprises two oppositely-arranged conveying rollers, at least one of and preferably both conveying rollers being provided with peripherally-arranged protrusions or cavities for engaging the granular material.

In this embodiment, the flow or mat of particular material is by means of the rotation of the conveying rollers accelerated to a velocity allowing for essentially linear transfer of the mat or flow of material to the grinding gap.

In a further embodiment of an apparatus according to the invention, the conveying device comprises a belt conveyer.

The belt is an endless belt running around two mutually spaced conveyer rollers, one of the rollers being a drive roller. The drive roller is preferably arranged at the proximal end of the conveying device.

The conveying device can comprise a single conveyer belt having an upper run on which the granular material is delivered from e.g. a feeding container so as to form a mat of material on the upper run.

In an additional embodiment of an apparatus according to the invention, the conveying device comprises two oppositely and parallel arranged belt conveyers.

The oppositely arranged belt conveyers physically constrain and accelerate the granular material supplied to the space between them to the desired velocity.

According to a further embodiment of an apparatus according to the invention, the conveying device comprising a single conveyer belt can further comprise a conveying device guide plate arranged opposite and parallel with a run of the belt conveyer facing the guide plate.

The mentioned run can advantageously be the upper run of the belt conveyer.

According to an additional embodiment of an apparatus according to the invention, the conveying device comprises a so-called belt thrower comprising two spaced conveyer drums, a belt extending between and around said drums and a deflection drum deflecting an upper run of the belt towards the lower run between the drums to impart the upper run a curved shape.

By means of the cooperation of the deflection drum and the belt and due to the rotational speed of the belt, the deflected shape of the upper run thereof and/or the rotational speed of the deflecting drum material supplied to the distal end of the belt is projected from the conveying device as a mat or flow of material with a velocity dependent of the rotational speed of the belt and/or the deflection drum.

The deflection drum can comprise two mutually spaced wheels engaging the upper run at spaced edges thereof.

The drums rotate at high speed and the granular material fed to the belt is accelerated to high speed over about 90° of the deflection drum and thrown out from the conveying device as a constrained mat or flow of material.

Alternatively, the deflection drum can be provided with a peripheral outer surface being provided with a plurality of blind holes or projections preferably at least essentially engaging the upper surface of the upper run of the belt. The material supplied to the distal end of the belt is grabbed between the belt and the deflection drum and by means of the rotation of the belt and the deflection drum projected from the conveying device as a mat or flow of material with a velocity dependent of the rotational speed of the belt and the deflection drum.

According to an additional embodiment of an apparatus according to the present invention, the transfer plane of the conveying device is arranged between essentially horizontal and 45° angled upwardly or downwardly relative to horizontal, such as between essentially horizontal and 30° angled upwardly or downwardly relative to horizontal, or such as between essentially horizontal and 15° angled upwardly or downwardly relative to horizontal.

According to an alternative embodiment of an apparatus, the transfer plane of the conveyer device is arranged between essentially vertical and 45° angled upwardly or downwardly relative to vertical, such as between essentially vertical and 30° angled upwardly or downwardly relative to vertical, or such as between essentially vertical and 15° angled upwardly or downwardly relative to vertical.

According to a further embodiment of an apparatus according to the invention can further comprise a guiding device defining a plane essentially coinciding with the transfer plane and comprising a single proximal, preferably planar guide plate or two oppositely arranged proximal guide plates, preferably planar guide plates, said guide plate/plates being arranged between the proximal end of the conveying device and the roller press.

The two oppositely arranged proximal guide plates can be essentially parallel or converge in the direction from the conveying device towards the roller press.

The single proximal guide plate can advantageously be arranged essentially horizontally and so that the mid-plane of the granular material mat arranged thereon essentially coincides with the mid-plane or transfer of the conveying device.

The two oppositely arranged proximal guide plates advantageously define a mid-plane essentially coinciding with the mid-plane or transfer plane of the conveying device.

In an additional embodiment of an apparatus according to the invention, one of the rollers of the roller press is a fixed roller and the other roller is movable in order to make the roller gab between the rollers adjustable. It should however be noted that both grinding rollers can de fixed rollers providing a fixed gap between the rollers.

The rollers of the roller press can be driven by separate motors. It should however be noted that can be driven by a common motor by means of a gear arrangement.

In an embodiment of an apparatus according to the invention the conveying device is operable at a speed providing the flow or mat of granular material with a speed of at least 2 m/s or at least 4, 6, 8, 10, 13, 16 or 18 m/s.

From the conveying device, the mat or flow of granular material can in the transfer plane be transferred directly to the grinding gap of the roller press unsupported i.e. through free air or supported or guided by a guiding device arranged between the conveying device and the roller press. It is at present considered most advantageous to transfer the granular material at least essentially unsupported, i.e. through free air, as the use of guides tends to decrease the velocity or the material. However, in order to project the material along a linear path a certain velocity is needed when the material is not projected downwardly. Additionally, guide plates can be needed at lower projection velocities.

The present invention further relates to a method for operating an apparatus according to the invention comprising feeding granular material to the conveying device and operating the conveying device at a speed providing the flow or mat of granular material with a speed of at least 2 m/s or at least 4, 6, 8, 10, 13, 16 or 18 m/s at the gap of the roller press.

The roller press of the apparatus according to the invention is preferably operable independent of the conveying device, whereby it is possible to adapt the operation of the roller press to the operation of the conveying device and vice versa in order to obtain a smooth and reliable operation of the apparatus and thereby the desired throughput and capacity of the apparatus.

BRIEF DESCRIPTION OF THE FIGURES

Embodiments of the present invention are described in the following with regards to the accompanying figures. The figures shows one way of implementing the present invention and are not to be construed as limiting for other possible embodiments falling within the scope of protection of the attached set of claims.

DETAILED DESCRIPTION OF THE INVENTION

Figure 1:
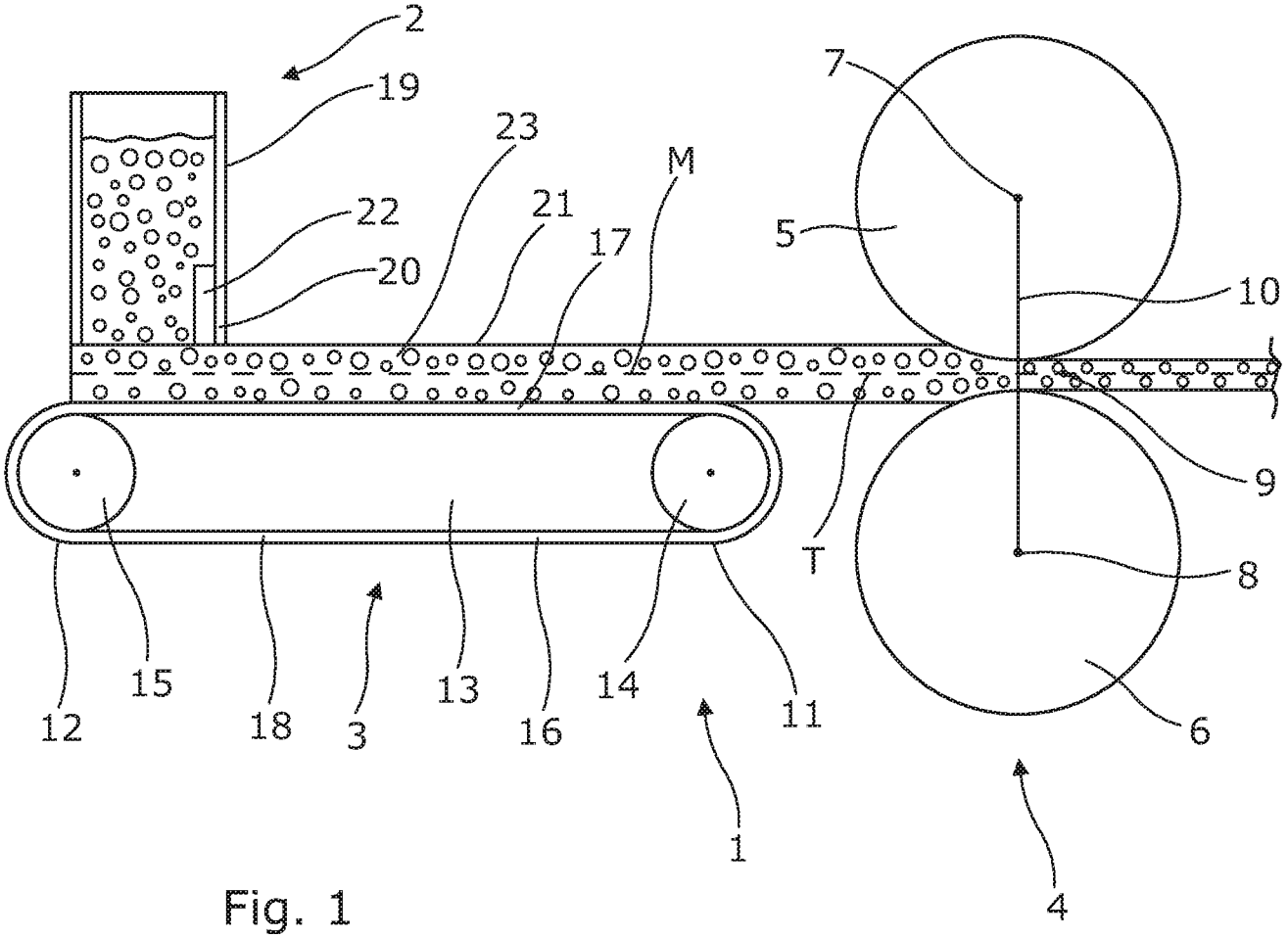
FIG. 1 is a diagrammatical lateral and partly sectional view of a first embodiment of an apparatus according to the invention in which the conveying device comprises a single belt conveyer, and granular material by means of the conveying device is transferred essentially horizontally through free air to the roller press.

As shown in FIG. 1, the first embodiment of an apparatus 1 according to the present invention for grinding particulate materials is a horizontally arranged apparatus comprising a feeding device 2, a conveying device 3 and a roller press 4.

The roller press 4 for grinding particulate material supplied thereto comprises a pair of grinding rollers 5, 6, each having a rotational axis 7, 8 and being arranged oppositely and parallel to define a grinding roller gap 9 in a common plane 10 through the axes 7, 8 of the grinding rollers 5, 6. A first one 6 of the grinding rollers is a lower and fixed roller and the second roller 5 is an upper and movable roller movable away from and towards the first roller 6, thereby allowing for adjustment of the size of the roller gap.

The conveying device is arranged and configured for conveying granular material 23 to the roller press 4 and has a proximal end 11 next to the roller press 4 and an opposite distal end 12. The conveying device comprises a belt conveyer 13 comprising two spaced conveyer rollers 14, 15 and an endless conveyer belt 16 extending around the two conveyer rollers. The belt has an upper run 17 and a lower run 18. In the present invention the belt is at its distal end supplied with particulate material by the feeding device 2.

The feeding device comprises a feeding container 19 with a lower outlet opening 20 feeding granular material to the distal end of the conveyer belt 13 arranged below the outlet opening 20. The size of the outlet opening 20 and thereby the amount of material delivered to the upper run 17 of the conveyer belt is adjustable by means of an adjustment means such as e.g. a gate 22, as shown in FIG. 1.

The speed of the belt 16 and the supply of granular material from the feeding container 19 through the lower outlet opening 20 thereof and onto to the upper run 17 of the belt is coordinated in such a way that a mat 21 of the granular material is formed on the upper run 17 of the belt. The mat 21 of granular formed on the upper run has in a cross sectional view an essentially rectangular shape with a mid-plane M. By means of the belt conveyer 13, the mat 21 is transferred directly to the grinding roller gap 9 of the roller press 4 in an essentially linear transfer plane T being essentially coincident with the mid-plane M and preferably essentially perpendicular to the common plane 10 through the axes 7,8 of the grinding rollers 5,6. From the proximal end of the belt conveyer, the mat is projected through the air into the grinding roller gap.

Figure 2:
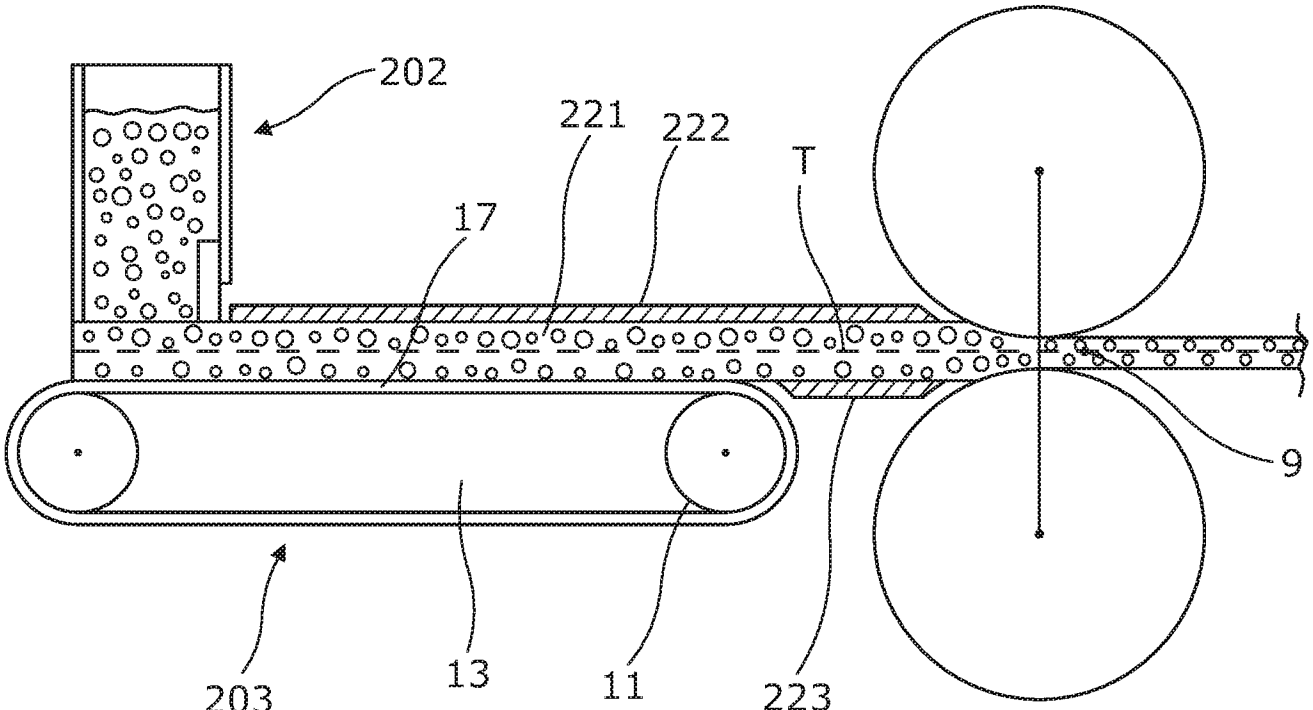
FIG. 2 is a diagrammatical lateral and partly sectional view of a second embodiment of an apparatus according to the invention being a modification of the above first embodiment and in which the material on the upper run of the belt conveyer is constrained by a conveying device guide plate, and the granular material is transferred to the roller press supported by a proximal lower guide plate.

The second embodiment of an apparatus 201 according to the invention shown in FIG. 2 is a modification of that shown in FIG. 1 and differs essentially therefrom in that the conveying device 203 thereof is provided with an upper conveyer guide plate 222 arranged essentially parallel to the upper run 17 of the belt conveyer 13. The upper conveyer guide plate constrains the mat 221 of granular material together with the upper run 17 of the belt conveyer 13. Additionally, the apparatus is provided with a lower proximal guide plate 223 arranged between the proximal end of the belt conveyer and the roller press 4 supporting the mat during the transfer to the grinding roller gap 9. The proximal guide plate can be omitted provided that the granular material is projected from the proximal end 11 of the belt conveyer with sufficient velocity to be transferred to the roller gap in the planar transfer plane T.

Figure 3:
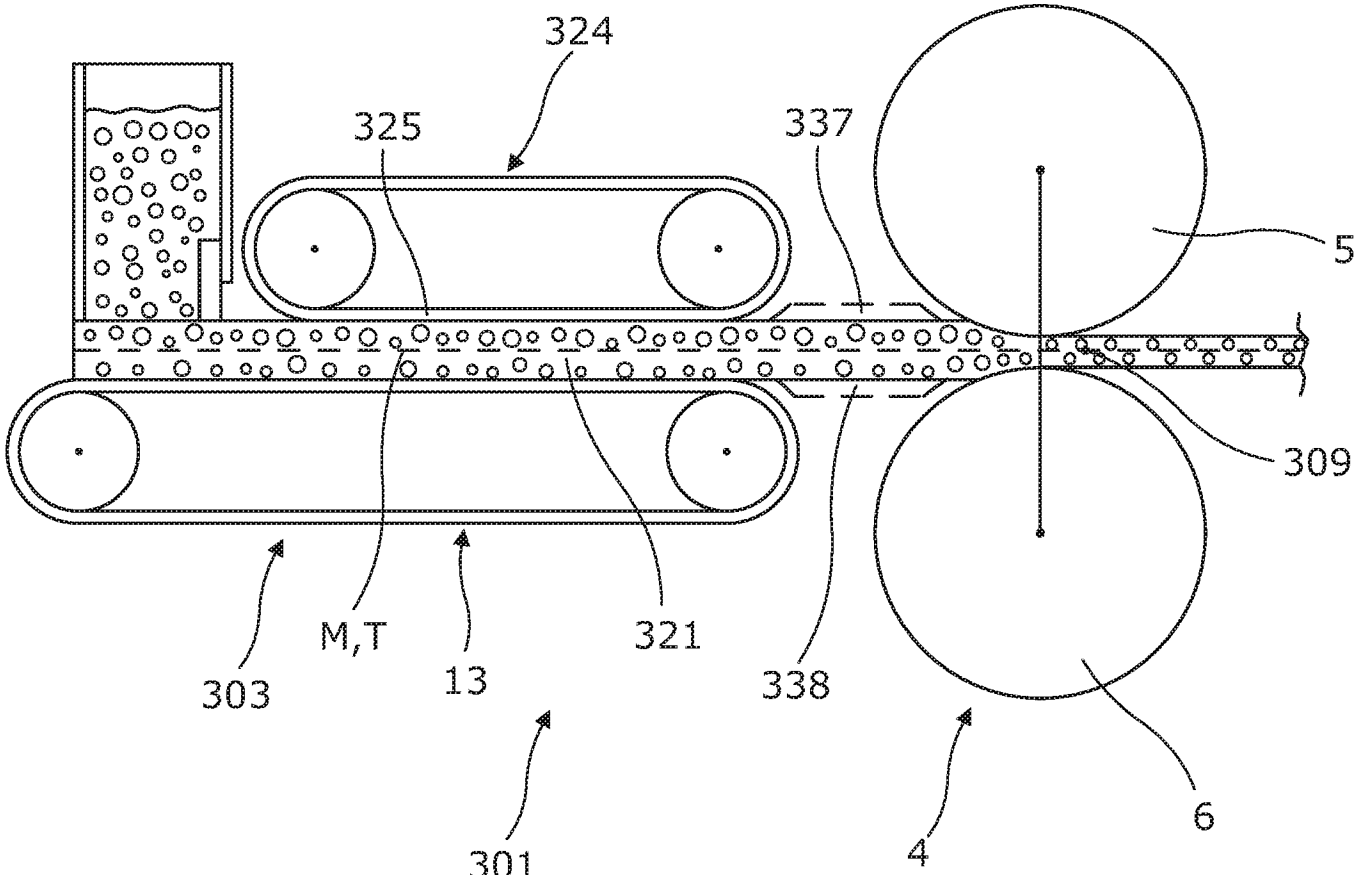
FIG. 3 is a diagrammatical lateral and partly sectional view of a third embodiment of an apparatus according to the invention in which the conveying device comprises two oppositely and parallel arranged belt conveyers, and the granular material is optionally transferred to the roller press supported by proximal guide plates.

The third embodiment of an apparatus 301 according to the invention is an alternative modification of the embodiment shown in FIG. 2. Instead of the upper conveyer guide plate, it comprises an upper belt conveyer 324 arranged spaces from and parallel to the lower belt conveyer 13. The lower run 325 of the upper belt conveyer and the upper run 17 of the lower belt conveyer constrain the mat 321 of material. Further in FIG. 3 it is indicated that the apparatus shown can be provided with an upper proximal guide plate 337 and/or a lower proximal guide plate 338 arranged between the proximal ends of the conveyers 324,13 and guiding the mat during the transfer to the grinding roller gap 9 of the roller press 4.

Figure 4:
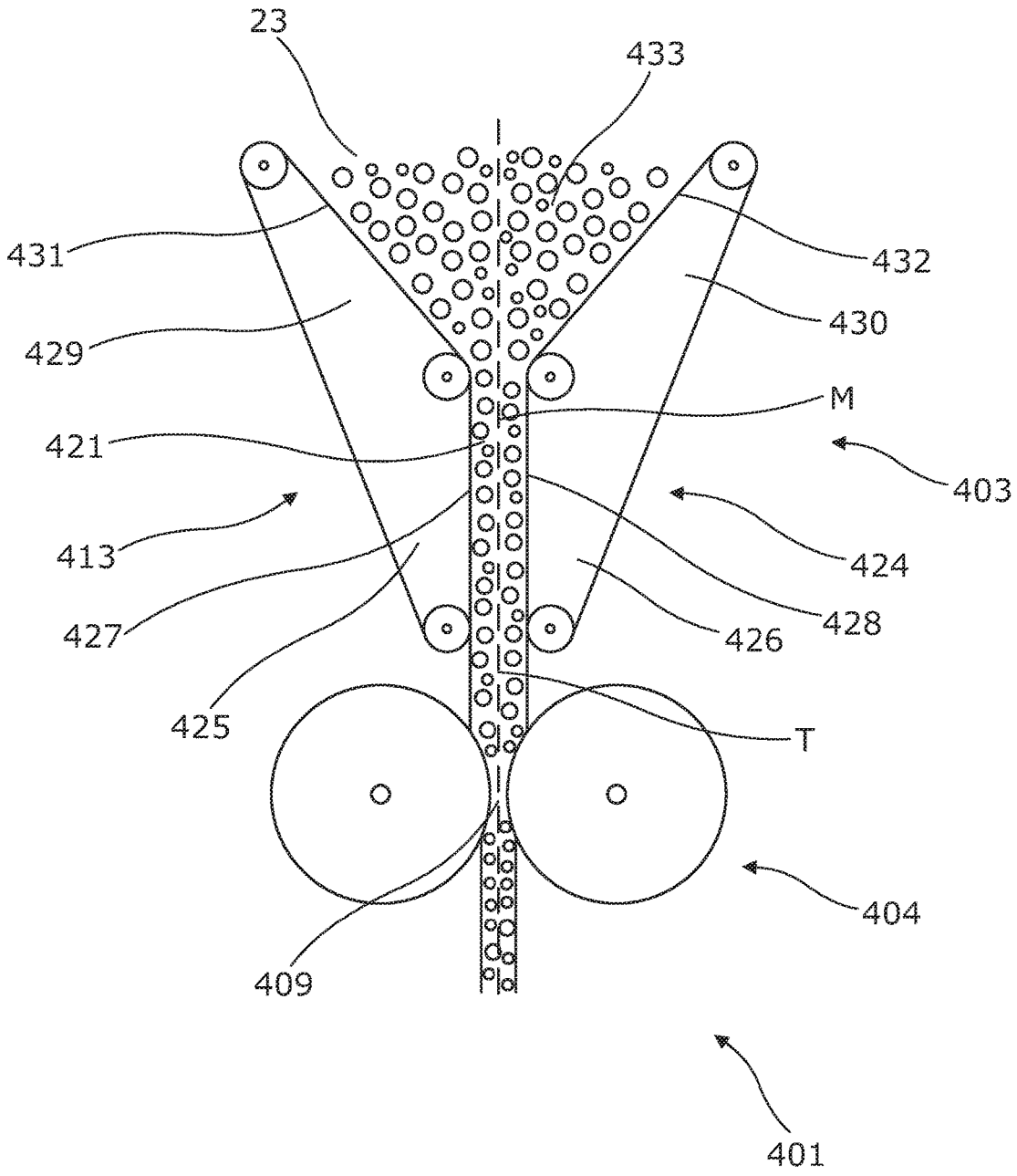
FIG. 4 is a diagrammatic lateral and partly sectional view of a fourth embodiment of an apparatus according to the invention being a vertically arranged apparatus in which the conveying device comprises two oppositely arranged belt conveyers, the distal upper portion thereof being formed by converging belt conveyer sections and the proximal lower portion by parallel belt conveyer sections.

The fourth embodiment of the invention shown in FIG. 4 is a vertical apparatus 401 in which the material flows or is moved vertically downwardly. The embodiment shown comprises a conveying device 403 having two oppositely and symmetrically arranged belt conveyers 413, 424, each comprising a lower conveyer section 425, 426 having facing parallel runs 427, 428 and an upper conveyer section 429, 430 having upper facing runs 431, 432 mutually diverging upwardly from the lower parallel facing runs.

Thereby, the upwardly diverging and facing upper runs 431,432 define a funnel-shaped feeding chamber 433 containing granular material 23 which is fed to the lower conveyer sections 425, 426 by the rotation of the conveyer belts of the belt conveyers. At the same time a mat 421 of granular material is formed and constrained by the lower facing and parallel runs 429, 430. The mat has seen in a cross sectional view a rectangular shape with a mid-plane M being essentially coincident with the planar transfer plane T in which the mat is transferred to the grinding roller gap 409 of the roller press 404.

Figure 5:
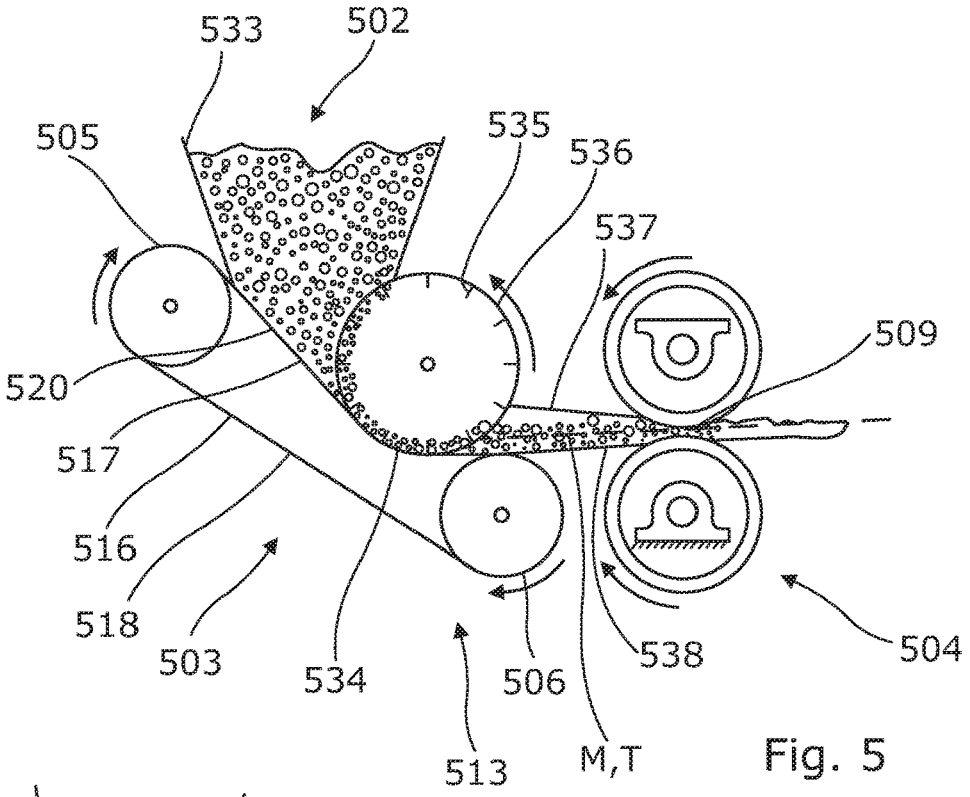
FIG. 5 is a diagrammatic lateral and partly sectional view of a fifth embodiment of an apparatus according to the invention in which the conveying device is formed by a first embodiment of a so-called belt thrower.

The fifth embodiment of an apparatus 501 according to the invention shown in FIG. 5 comprises a conveying device 503 formed as a so-called belt thrower comprising belt conveyer 513, having two mutually spaced conveyer drums 505,506 and a belt 516 extending between and around the drums, and a deflection drum 534 deflecting between the conveyer drums the upper run 517 of the belt towards the lower run 518 of the belt to impart the upper run with a curved shape. The deflection drum 534 is provided with several blind holes 535 in the peripheral outer surface 536 thereof. A feeding device 502 comprises a funnel-shaped feeding chamber 533 having a lower outlet opening 520 through which particular material is supplied to the distal end of the belt conveyer 513. The particular material is trapped in the blind holes and between the outer surface of the deflection drum and the upper run of the belt and by means of the rotational speed or the belt and the deflection drum projected rectilinear as a mat or flow of material having, as seen in a cross sectional view, a rectangular shape with a mid-plane M being essentially coincident with the transfer plane T in which the material is transferred from the conveying device into the grinding roller gap 509 of the roller press 504.

Additionally, and as indicated in FIG. 5, the embodiment of the invention shown can comprise an upper proximal guide plate 537 and a lower proximal guide plate 538 arranged between the proximal end of the conveying device 503 and the roller press 504. The guide plates converge as seen from the proximal end of the conveying device towards the roller press 504 and define a central plane being coincident with the transfer plane T.

Figure 6:
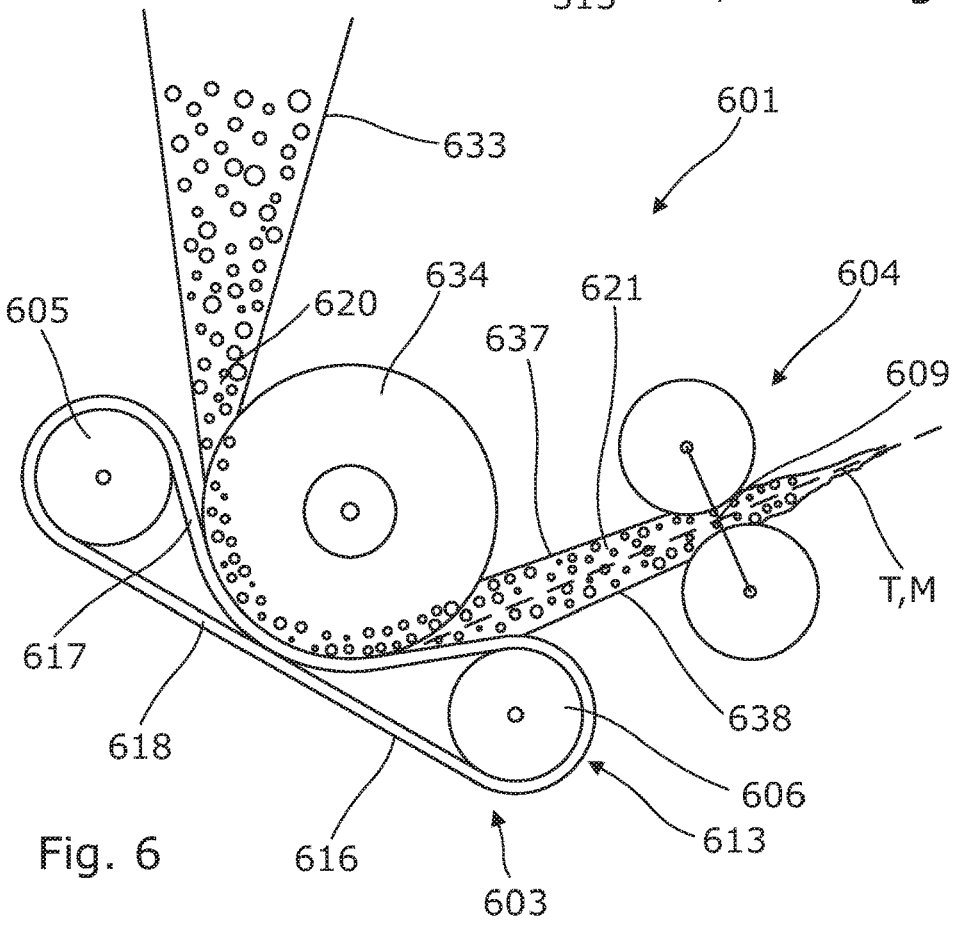
FIG. 6 is a diagrammatic lateral and partly sectional view of a sixth embodiment of an apparatus according to the invention in which the conveying device is formed by a second embodiment of a so-called belt thrower.

The embodiment of the apparatus 601 according to the invention shown in FIG. 6 is similar to that shown in FIG. 5 in that it comprises a conveying device 603 formed as a so called belt thrower comprising a belt conveyer 613, having two mutually spaced conveyer drums 605, 606 and a belt 616 extending between and around the drums, and a deflection drum 634 deflecting between the conveyer drums the upper run 617 of the belt towards the lower run 618 of the belt to impart the upper run with a curved shape. The deflection drum 634 is provided with two mutually spaced wheels each having a peripheral face engaging the upper run of the belt at spaced edges thereof. A feeding device 602 comprises a funnel-shaped feeding chamber 633 having a lower outlet opening 620 through which particular material is supplied to the distal end of the belt conveyer 613. The particular material is from the opening of the feeding chamber delivered to the upper run 617 at the distal end of the belt conveyer. The conveyer drums 605, 606 rotate with high velocity and the granular material fed to the upper run of the belt is accelerated to a high velocity over about 90° of contact between the deflection drum and the belt and thrown out from the belt of the conveying device as a constrained mat 621.

Additionally, and as indicated in FIG. 6, the embodiment of the invention shown can comprise an upper proximal guide plate 637 and a lower proximal guide plate 638 arranged between the proximal end of the conveying device 603 and the roller press 604. The guide plates converge as seen from the proximal end of the conveying device towards the roller press 604 and define a central plane being coincident with the transfer plane T. The guide plates may however also be omitted so that is transferred through free air from the belt of the conveyer device to the grinding roller gap 609.

Figure 7:
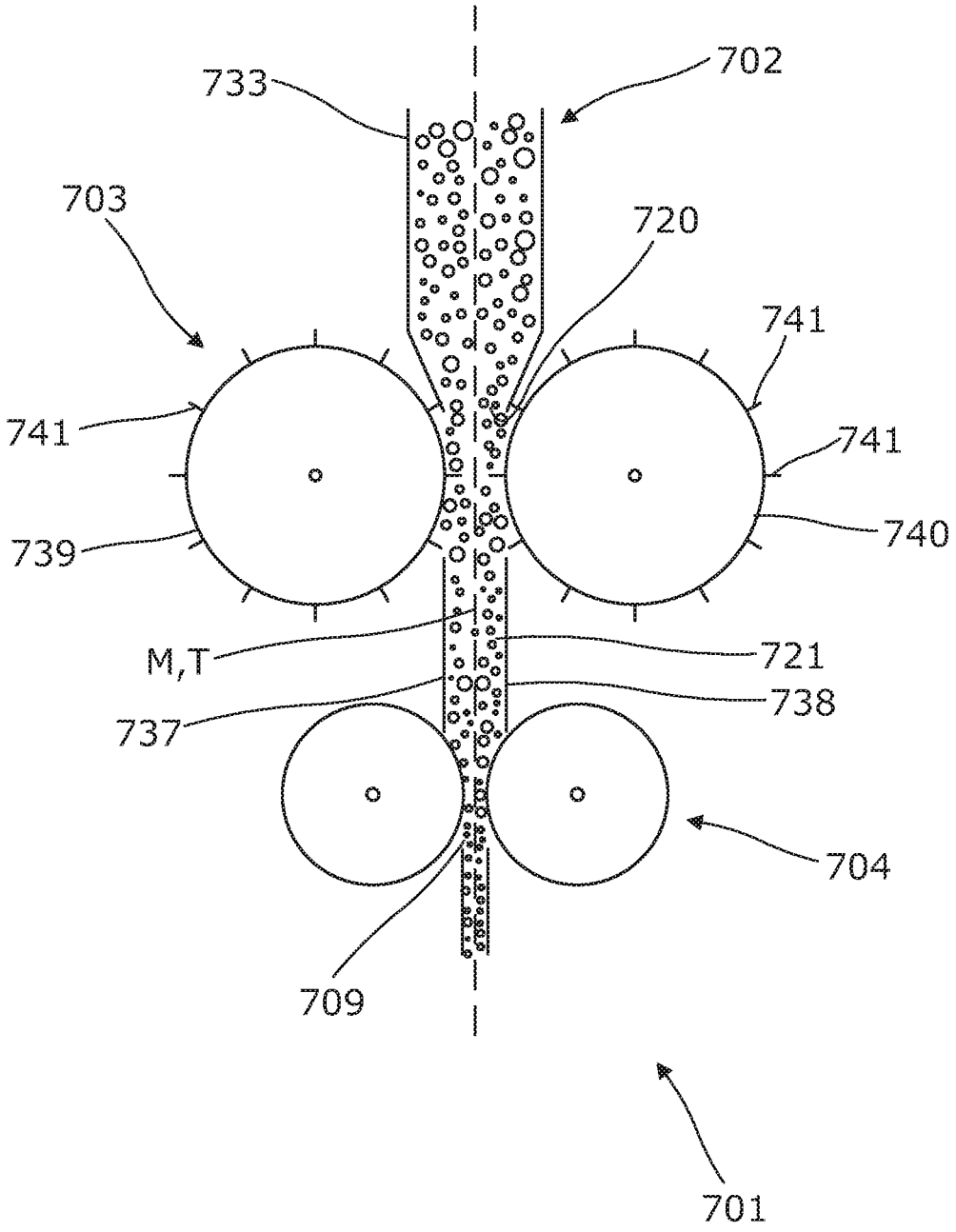
FIG. 7 is a diagrammatic lateral and partly sectional view of a seventh embodiment of an apparatus according to the invention being a vertical arranged apparatus in which the conveying device comprises two oppositely arranged conveying rollers being provided with peripherally arranged protrusions for engaging the granular material.

The embodiment shown in FIG. 7 is a vertical apparatus 701 in which the particular material flows or is moved vertically downwardly. The embodiment shown comprises a conveying device 703 having two oppositely arranged rotatable conveying rollers 739,740 each being provided with peripherally arranged protrusions 741 for engaging particular material. A feeding device 702 comprising a feeding chamber 733 with a lower outlet opening 720 supplies particulate material to the arear between the two conveying rollers. The rollers rotates in the direction towards the roller press 704 arranged below the conveying rollers. Thereby the speed of the granular material delivered by the feeding device is accelerated and projected towards the grinding roller gap 709 as a mat 721 having a mid-plane M being coincident with the transfer plane T in which the mat or flow of material is transferred from the conveying device 703 to the gap 709. The mentioned transfer can take place in free air. Alternatively mutually spaced guide plates 737, 738 can be arranged between the proximal end of the conveying device 703 and the gap 709 of the roller press.

LIST OF REFERENCE NUMERALS

1, 201, 301, 401, 501, 601, 701 apparatus
2, 502, 702 feeding device
3, 203, 303, 403, 503, 603, 703 conveying device
4, 404, 504, 604, 704 roller press
5 first roller, upper
6 second roller, lower
7 rotational axis, upper
8 rotational axis lower
9, 309, 409, 509, 609, 709 grinding roller gap
10 common plane
11 proximal end
12 distal end
13, 313, 513, 613 belt conveyer
14 conveyer roller
15 conveyer roller
16, 516, 616 belt
17, 517, 617 upper run
18, 518, 618 lower run
19 feeding container
20, 520, 620, 720 outlet opening
21, 221, 321, 421, 621, 721 mat or flow of material
22 gate
23 granular/particulate material
M mid-plane
T transfer plane
222 upper conveyer guide plate
223 lower proximal guide plate
324 upper belt conveyer
325 lower run
337, 537, 637 upper guide plate
338, 538, 638 lower guide plate
413 belt conveyer
424 belt conveyer
425, 426 lower conveyer section
427,428 lower facing runs
429,430 upper conveyer section
431, 432 upper facing runs
433, 533, 633, 733 feeding chamber
505, 506 conveyer drums
605, 606 conveyer drums

534, 634 deflection drum
535 holes
536 outer surface
737, 738 guide plate
739, 740 conveying roller
741 protrusions

The invention claimed is:

1. An apparatus for grinding particulate material comprising:

a roller press for grinding the particulate material, the roller press comprising a pair of grinding rollers each having a rotation axis and being arranged oppositely and parallel to define a grinding roller gap; and a conveying device for conveying granular material to the roller press, the conveying device having a proximal end and a distal end relative to the roller press, the roller press being arranged at the proximal end of the conveying device;

wherein the conveying device is arranged and configured to transfer a flow or mat of granular material directly to the grinding roller gap of the roller press in use; and wherein the conveying device comprises a belt conveyer comprising two spaced conveyer drums, a belt extending between and around the conveyer drums, and a deflection drum deflecting, between the conveyor drums, an upper run of the belt towards a lower run of the belt to impart the upper run of the belt with a curved shape.

2. The apparatus of claim 1, wherein the deflection drum is provided with several blind holes in a peripheral outer surface thereof for trapping the granular material therein and between the outer surface of the deflection drum and the upper run of the belt.

3. The apparatus of claim 1, wherein the conveying device further comprises a conveying device guide plate arranged between the proximal end of the conveying device and the roller press.

4. The apparatus of claim 1, wherein the deflection drum comprises two mutually spaced wheels engaging the upper run at spaced edges thereof.

5. The apparatus of claim 1, wherein a transfer plane of the conveying device is arranged between horizontal and 45° angled upwardly or downwardly relative to horizontal.

6. A method for operating the apparatus of claim 1, comprising feeding granular material to the conveying device and operating the conveying device at a speed providing the flow or mat of granular material with a speed of at least 2 m/s at the grinding roller gap of the roller press.

7. The method of claim 6, wherein the roller press is operated independent of the conveying device.

8. The apparatus of claim 1, wherein a transfer plane of the conveying device is arranged between vertical and 45° angled upwardly or downwardly relative to vertical.

9. The apparatus of claim 1, wherein the conveying device is operable at a speed providing the flow or mat of granular material with a speed of at least 2 m/s.

10. The apparatus according to claim 1 wherein one of the rollers of the roller press is a fixed roller and the other one of the rollers of the roller press is movable in order to make the grinding roller gap between the rollers adjustable.

11. The apparatus according to claim 1, wherein the rollers of the roller press are driven by separate motors.

12. The apparatus according to any claim 1, wherein the rollers of the roller press are driven by a common motor by means of a gear arrangement.

13. The apparatus according to claim 1, wherein the roller press is operable independent of the conveying device.

* * * * *